US005161394A

United States Patent [19]

Felzer et al.

[11] Patent Number: 5,161,394

[45] Date of Patent: Nov. 10, 1992

[54] WASHING MACHINE

[76] Inventors: William Felzer, 2925 Rivera St., San Francisco, Calif. 94116; William Marquardt, 259 Judson Ave., San Francisco, Calif. 94112; Lawrence Chi Ai, 120 Capp St., San Francisco, Calif. 94110; Nam Q. Dang, 1091 Bush St., #203, San Francisco, Calif. 94109; Earnest J. Gladney, 761 Fillmore St., San Francisco, Calif. 94117; Keith L. Moore, 704 Andover St., San Francisco, Calif. 94110; Vicente Oropeza, 3554-20th St., San Francisco, Calif. 94110; Edgar Sanchez, 2818 Folsom St., San Francisco, Calif. 94110; Ying Zhou, 730 Stockton St., San Francisco, Calif. 94108

[21] Appl. No.: 736,408

[22] Filed: Jul. 26, 1991

[51] Int. Cl.[5] ..... D06F 17/04

[52] U.S. Cl. ..... 68/23 R; 68/184; 68/207

[58] Field of Search ..... 68/18 F, 23 R, 23.5, 68/184, 205 R, 207

[56] References Cited

U.S. PATENT DOCUMENTS

| | | | |
|---|---|---|---|
| 1,474,277 | 11/1923 | Martel et al. | 68/184 |
| 2,331,379 | 10/1943 | Dyer | 68/184 |
| 2,358,691 | 9/1944 | Dehle | 68/184 |
| 2,711,641 | 6/1955 | Groff | 68/184 |
| 2,969,665 | 1/1961 | Saverio | 68/184 |
| 3,664,159 | 5/1972 | Mazza | 68/205 R |
| 4,325,235 | 4/1982 | Bauer | 68/3 SS |
| 4,744,228 | 5/1988 | Goldberg | 68/20 |

FOREIGN PATENT DOCUMENTS

| | | | |
|---|---|---|---|
| 1145503 | 5/1957 | France | 68/184 |

*Primary Examiner*—Philip R. Coe

[57] ABSTRACT

A laundry machine is constructed to discharge liquid from fixed nozzles located within a fixed tub, through holes in the bottom of a basket within the tub. The liquid impacts and levitates the clothes within the basket. The liquid is recycled through the pump. Extraction of liquid from clothes is by spin rotation of the basket.

2 Claims, 3 Drawing Sheets

WASHING MACHINE

BACKGROUND—FIELD OF INVENTION

This invention relates to improvements made to washing machines for clothing, specifically the replacement of paddle agitators with directed water jets combined with tub and shaped, perforated basket.

BACKGROUND—DESCRIPTION OF PRIOR ART

The washing of fabrics and clothing has occurred throughout recorded human history. Some methods of accomplishing the washing includes: the impact of pounding clothes on rocks, the rubbing of clothes against a washboard or other rough surface, the water motion of a flowing stream, the rocking motion of clothes in a tub, the stationary soaking of clothes in a tub, spraying water onto hanging clothing, the vertical pulsation of an agitator in a tub, the reversing circular motion of an agitator in a tub, the oscillation motion of a tub having paddles on its inside surface, the use of sonic (or ultrasonic) pulses via an agitator, and the oscillation of a drum about its horizontal axis.

The present embodiment of the washing machine is distinguished from most prior art (a) by a low washing liquid level that does not submerge the clothing being washed, (b) by the absence of a paddle agitator, (c) the absence of abrasive action to effectuate cleaning, and (d) the presence of a perforated, sloping basket bottom and a sloping tub bottom.

The present embodiment is distinguished from the machines apparently similar as follows:

U.S. Pat. No. 4,325,235 (Bauer, 1982) shows an agitatorless machine deriving its motive power from water pressure in the supply hose, combined with the introduction of air, which features are not claimed herein. Spin drying is not shown.

U.S. Pat. No. 3,664,159 (Mazza, 1972) teaches a device for cleaning clothing hung on a plurality of support members built into the top of a cabinet directing liquid upon the vertically-hanging articles, using a shaking action for dewatering. In contrast, our invention uses a tub and clothes basket without the hanging of garments, and spin drying is present.

U.S. Pat. No. 4,744,228 (Goldberg, 1988) shows a jet entering the bottom of a tub full of water being circulated by torroidal water flow path for agitation, with the spin accomplished by magnetic coupling through the non-magnetic (plastic) tub bottom, and a readily-removable tub than can be transferred to a clothes dryer. In contrast, our invention uses low water level that does not submerge the clothing, levitation that raises the clothing during washing and the absence of any claim for the material of construction or magnetic drive for the basket in the tub.

U.S. Pat. No. 1,474,277 (Martel et al., 1923) uses a tub with side-mounted nozzles at different heights directing. In contrast, our invention has its nozzles directed upward through a basket recirculating liquid from a single pump through stationary nozzles.

U.S. Pat. No. 2,331,379 (Dyer, 1943) shows horizontal nozzles directing liquid inward over a false bottom from a central pump. In contrast, our invention has nozzles directed generally upward, and no claim is made for central pump mounting.

U.S. Pat. No. 2,358,691 (Dehle, 1944) directs water jets upward through the bottom of a water-filled tub to produce agitation in the water-filled tub. In contrast, our invention has a very low water level, with the nozzle action levitating the clothes for washing action in a predominantly air-filled basket inside the tub.

U.S. Pat. No. 2,711,641 (Groff, 1955) operates by a rotary valve alternately directing water to various upwardly-directed and downwardly-directed nozzles to achieve agitation by jet nozzles facing each other. A separate spin basket is not claimed or shown. In contrast, our invention does not rely on mechanical valves to modulate water pressure and flow rate alternately. Our invention incorporates spin extraction.

U.S. Pat. No. 2,969,665 (Saverio, 1961) shows a basket inside a tub, at the bottom of which is a centered centrifugal pump, so arranged that its impeller directs washing liquid into upward arcs by deflecting liquid emerging from its impeller. Our invention, in contrast, has a separate pump and nozzles discharging liquid through holes in the basket for liquid motion. In addition, his invention uses disc clutches as opposed to no disc clutches in our invention.

French Patent Nr. 1,145,503 (Moulin, 1957) shows a single tub with both upwardly and downwardly pointing nozzles agitating the clothing and separate skimming liquid paths. It does not show spin extraction. In contrast, our invention uses a basket inside a tub and two motors—one for circulation and another for spin extraction. In addition, our invention shows in-line filtration.

In Dyer, Dehle, Groff, Saverio, and Moulin, the energy of the jets is inefficiently dissipated when it impacts a body of liquid. In our invention, the full impact of the jets is directed onto the clothing and fabrics.

Other fields of washing use water spray. These uses are steam cleaners for automotive equipments and parts, pressure washers for building cleaning, spray nozzles without spin drying for dishwashers, manually operated hoses for spray cleaning, and clean-in-place spray nozzles for food tanks and food cooking equipment.

There have been hundreds of United States patents issued washing machine and components thereof. Our searches have revealed none like our invention, either as patents or as published literature.

This invention differs from all of these examples of washing using nozzles in that there is no recorded prior art or patents using nozzles alone for levitating and washing clothing and fabrics after the manufacturing has been completed that also uses spin drying. This invention is not obvious as evidenced by the multitude of patents already issued that teach away from or that do not teach or claim the methods herein for clothes washing.

The motivation to investigate washing machines came during the fifth year of the current northern California drought—and the searching for ways to save water.

OBJECTS AND ADVANTAGES

Several objects and advantages of our present invention are:

(a) to provide a washing machine that uses less water than machines currently in use;

(b) to provide a machine of reduced manufacturing cost, as a result of reduced complexity and weight than existing machines; and (c) to provide a machine which produces less clothing and fabric tangling, less tearing, and less loss of buttons and fasteners than current machines.

BRIEF DESCRIPTION OF DRAWING FIGURES

FIGS. 1 to 3 show various aspects of the present embodiment of the washing machine improvements.

FIG. 1 shows a cross-section taken through the centerline of a typical washing machine utilizing the invention. FIG. 1 shows the basic features of the invention, notably the nozzles in relation to the openings in the basket and the discharge of liquid jets into the basket. It also shows the configuration of the means for rotating the basket shaft and basket, as well as the mechanism for holding the basket.

Figure 1:
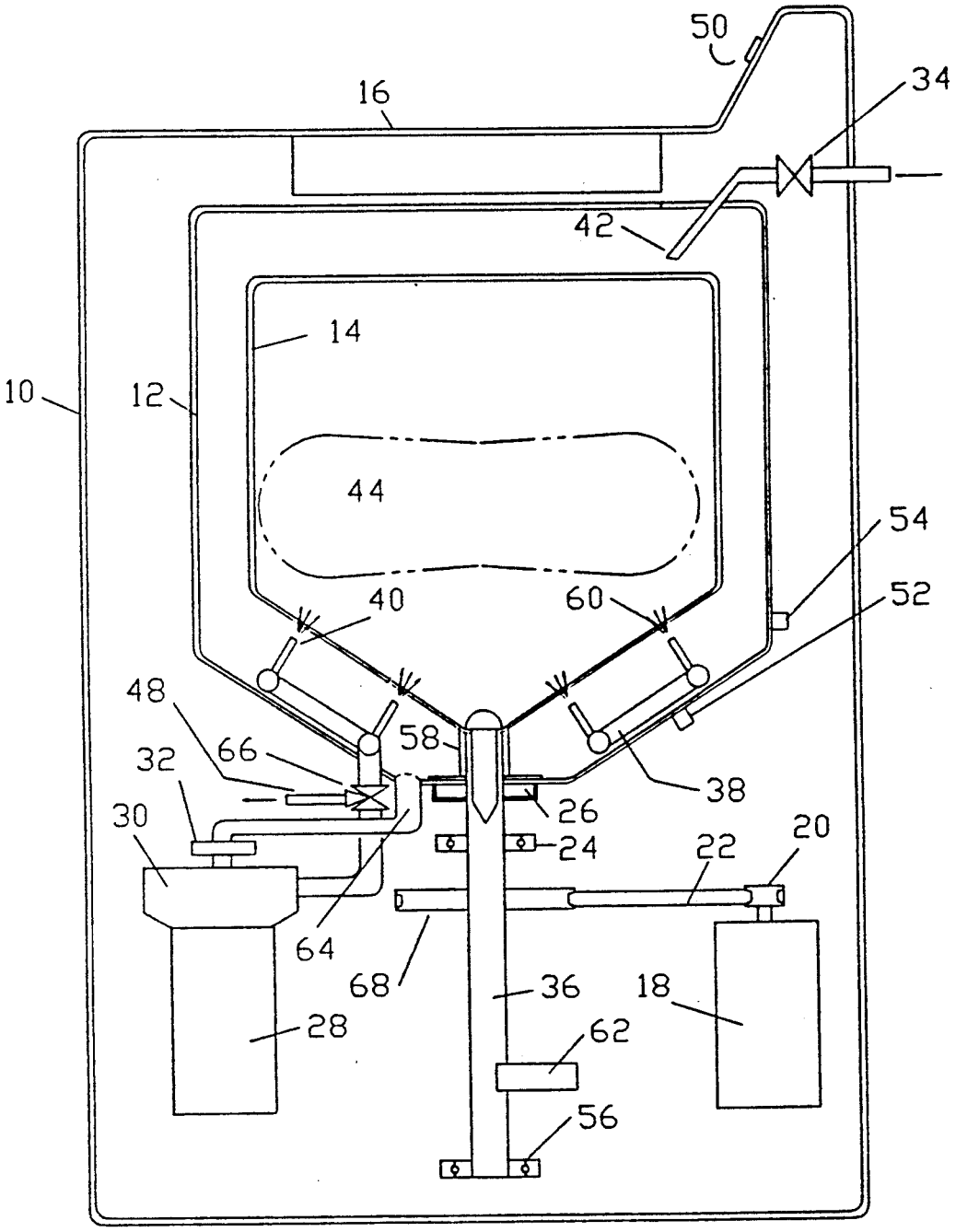

To those practicing the art, it is obvious that several variations of this teaching are possible.

REFERENCE NUMERALS IN DRAWINGS

| | |
|---|---|
| 10 housing | 12 tub |
| 14 basket | 16 cover door |
| 18 basket spin motor | 20 basket spin pulley |
| 22 basket spin belt | 24 radial bearing |
| 26 shaft liqid seal | 28 pump motor |
| 30 pump | 32 filter |
| 34 solenoid valve | 36 basket shaft |
| 38 liquid conduit | 40 nozzle |
| 42 water fill spout | 44 clothing and fabrics |
| | 48 drain conduit |
| 50 control panel | 52 liquid low level sensor |
| 54 liquid high level sensor | 56 thrust and radial bearing |
| 58 spacer | 60 holes |
| 62 holding mechanism | 64 liquid |
| 66 drain solenoid valve | 68 basket shaft pulley |
| 70 solenoid | |
| 82 nozzle venturi | |

DESCRIPTION OF PREFERRED EMBODIMENT OF INVENTION—FIGS. 1 to 5

A typical embodiment of the washing machine in FIG. 1 shows a housing 10 with control panel 50 and cover door 16 that contains inside a watertight tub 12. Inside said tub 12 is a basket 14 held atop a basket shaft 36 which is held stationary during water flow by shaft stopping and holding mechanism 62 and which rotates during spin drying by basket spin motor 18. Leakage from tub 12 is prevented by its watertight construction and by shaft liquid seal 26. Liquid 64 consists of water, detergent, bleach, enzyme cleaners, solvent, or a combination thereof. Liquid 64 is contained by the tub 12, liquid conduit 38, filter 32, pump 30, and passes through a plurality of nozzles 40.

Continuing with FIG. 1, the bottom of basket 14 is perforated with holes 60 so that they are capable of alignment with the nozzles 40. Liquid low level sensor 52 and liquid high level sensor 54 help control the control solenoid valve 34 and drain solenoid valve 66. Pump motor 28 is coupled to pump 30 mechanically. The basket shaft 36 holds basket 14 on one end and is supported by thrust and radial bearing 56 and radial bearing 24. Basket spin motor 18 has basket spin pulley 20 and basket spin belt 22 attached thereto.

The housing 10 and components not specifically claimed as invention are essentially conventional.

In FIG. 1 the holding mechanism 62 is a mechanism for causing the nozzles 40 to be aligned with the holes 60 in the basket 14 in a plurality of stopping positions.

Figure 2:
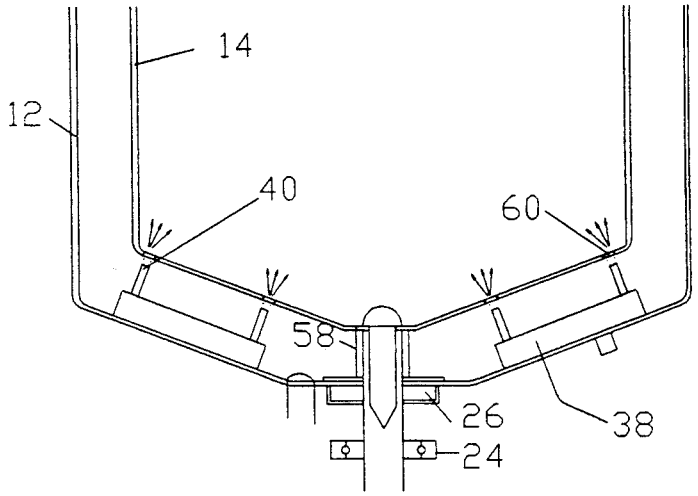
FIG. 2 shows cross section of an alternate embodiment in which liquid conduit that takes the form of a hard material into which nozzles are placed as a replacement for piping and a different angle for basket and tub bottom.

In FIG. 2 an alternate embodiment of liquid conduit 38 are made by forming a conduit with one or more sides integral with the bottom of the tub 12.

Figure 3:
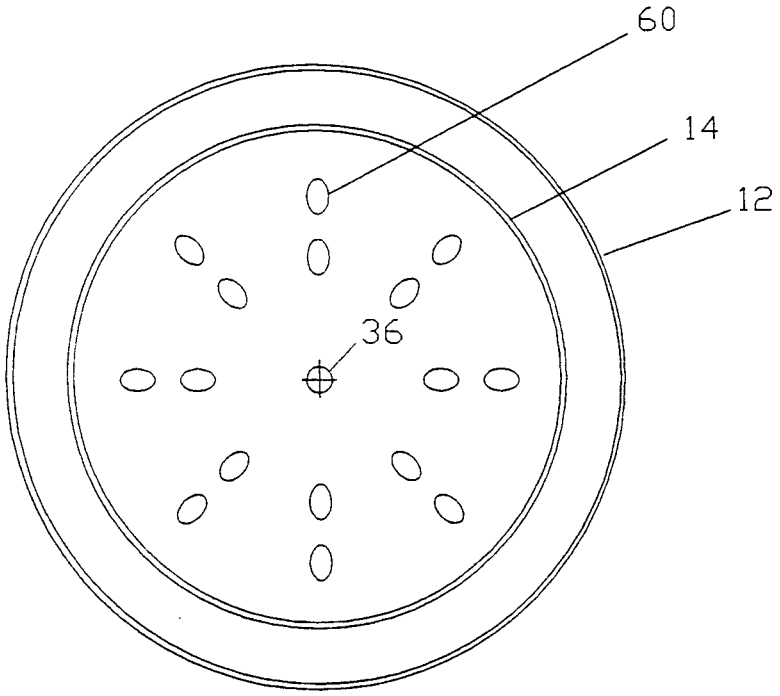
FIG. 3 shows a plan view of the basket bottom showing one possible embodiment of hole and nozzle arrangement. Other hole quantities and arrangements are also feasible.

In FIG. 3, the shape of holes 60 in basket bottom of basket 14 is shown.

Figure 4:
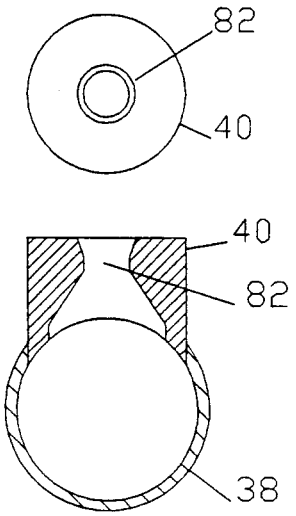
FIG. 4 shows the shape of the nozzles in the preferred embodiment of the machine. A end view and a cross section view are shown.

In FIG. 4 the shape of the nozzles 40 in the preferred embodiment of the machine is shown.

Figure 5:
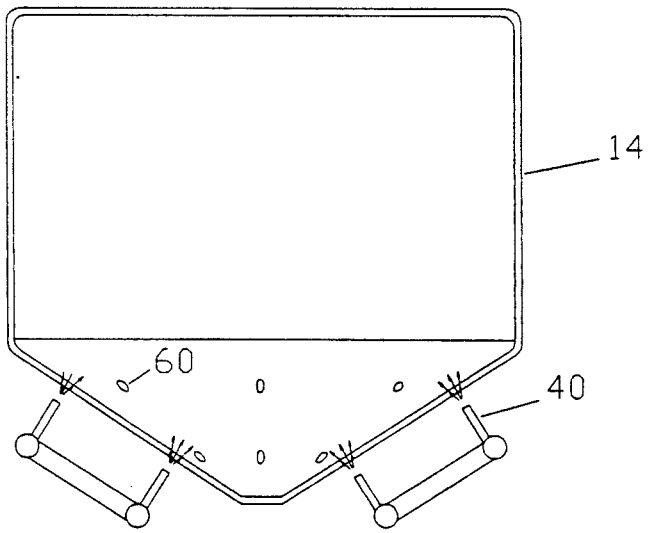
FIG. 5 is a cross section through the center of the basket and shows the shape of the holes in the preferred embodiment of the bottom of the basket so that liquid can pass through them.

In FIG. 5 the shape of the holes 60 in the preferred embodiment of the bottom of the basket 14 is shown.

From the description above, a number of advantages of our washing machine become evident:

(a) The washing machine embodiment provides reduced manufacturing cost, as a result of reduced complexity and weight from existing machines, since a gear agitator drive and an agitator are not used; and (b) The washing machine embodiment provides a machine which produces less clothing and fabric tangling, less tearing, and less loss of buttons and fasteners than current machines, by means of absence of hard surface impact through the absence of an agitator.

SUMMARY, RAMIFICATIONS AND SCOPE

Accordingly, the reader will see that the washing machine directs water jets upward to levitate and clean the clothing through the action of the cleaning fluid's impact and turbulence.

The invention of the above application will materially enhance the quality of the environment by reducing the quantity of water taken from nature for laundry purposes.

The invention will permit the washing of clothing by the use of less water by the act of spraying recirculating water as opposed to filling a tub to a level immersing clothing and using mechanical agitation as is done presently in vertical-axis washing machines and as opposed to the larger volume of water used in horizontal-axis washing machines.

The water savings will be at least 30% of the water used. The use of less water will mean less water diverted from nature and the environment to laundry use. The use of less water will produce a smaller volume of waste water that needs to be treated at waste disposal plants, since the volume of water treated is more significant than the weight of solids suspended in the waste water.

The washing machine will require less material weight to accomplish results substantially the same as accomplished by conventional washing machines, thereby using less mineral ore that will be extracted, milled, smelted, produced and transported for said washing machines.

In addition, the invention will materially save energy. The washing machine result in the use of less electrical energy to clean clothes by eliminating energy losses used to operate an agitator and its gear train. Additionally, the washing machine will use substantially less water to clean clothes, thus reducing water supply electrical water pumping costs and waste water pumping costs in many parts of the country and world.

Although the description above contains many specificities, these should not be construed as limiting the scope of the invention but as merely providing illustrations of some of the presently preferred embodiments of this invention. For example, the jets can have other orifice shapes, other arrangements of nozzles, other locations, other tub shape, etc.

Thus the scope of the invention should be determined by the appended claims and their legal equivalents, rather than by the examples given.

OPERATION OF THE PREFERRED EMBODIMENT OF THE INVENTION—FIGS. 1 TO 5

Referring to FIG. 1, the manner of using our washing machine has the clothing, textiles and the like being introduced into the basket 14 manually through cover door 16. After water or other components of liquid 64 have entered through inlet solenoid valve 34, pump motor 28 rotates and causes pump 30 to move liquid 64 from the bottom of tub 12 through liquid conduit 38 through filter 32 to pump 30, and thence through more liquid conduit 38 to a plurality of nozzles 40. The liquid flow from nozzle 40 passes through holes in basket 60 onto clothing and fabrics 44. Lint and coarse dirt is removed from liquid 64 by filter 32 before entering pump 30 and nozzle 40.

In FIG. 2 the liquid 64 passes through an alternate embodiment of liquid conduit 38.

In FIGS. 1 and 3 the holes in basket 60 are shown in one possible embodiment of the invention, arranged so that liquid 64 from nozzles 40 attached to stationary tub 12 pass through said holes in basket 60 when the shaft holding mechanism 62 causes alignment of said holes 60 and nozzles 40. The holes 60 in basket 14 are preferably elliptical in shape. In FIG. 1 the pump 30 produces a pressure and flow rate adequate to wash the clothing and fabrics 44.

Having thus described our invention, we claim:

1. A washing machine apparatus, comprising:

(a) a tub having a bottom and sides, (b) a basket for containing fabric to be cleaned, said basket having a bottom and sides, said basket further having perforations in said bottom of said basket, said basket being disposed within said tub, (c) pump means for pumping liquid into said perforated basket, said pump means further being capable of recirculating said liquid between said tub and said basket, (d) a plurality of nozzles in fluid communication with said pump means, mounted at or near said bottom of said tub and outside said basket, and capable of sending jets of said liquid into said basket through said perforations of said basket so that the fluid velocity of said liquid flowing therethrough produces levitation of said fabric to be cleaned and an impact force, which, in conjunction with the solvent properties of said liquid, provides the means to clean said basket contents, wherein said fabric to be cleaned is levitated and agitated by action of said liquid discharged from said nozzles, (e) a vertical basket shaft connecting with said basket and capable of being rotated so as to permit shaft rotary motion to spin said basket, and (f) a basket holding means for holding said basket at locations where said perforations in said basket are aligned with said nozzles mounted on said tub.

2. The invention of claim 1 wherein said basket holding means for causing said basket perforations to become aligned with said nozzles has a plurality of stopping positions that can cause alignment of said basket bottom perforations and said nozzles.

* * * * *